US007431292B2

(12) United States Patent
Goto

(10) Patent No.: US 7,431,292 B2
(45) Date of Patent: Oct. 7, 2008

(54) MEDIUM CONVEYING APPARATUS

(75) Inventor: Youichi Goto, Fukushima (JP)

(73) Assignee: Oki Data Corporation, Tokyo (JP)

( * ) Notice: Subject to any disclaimer, the term of this patent is extended or adjusted under 35 U.S.C. 154(b) by 355 days.

(21) Appl. No.: 10/849,076

(22) Filed: May 19, 2004

(65) Prior Publication Data

US 2004/0251619 A1 Dec. 16, 2004

(30) Foreign Application Priority Data

May 22, 2003 (JP) ..... 2003-144355

(51) Int. Cl.
*B65H 5/02* (2006.01)

(52) U.S. Cl. ..... 271/272; 271/273; 271/274

(58) Field of Classification Search ..... 271/272–274
See application file for complete search history.

(56) References Cited

U.S. PATENT DOCUMENTS 3,241,665 A * 3/1966 Erk ..... 209/577
4,163,550 A * 8/1979 Armstrong ..... 271/274
4,619,451 A * 10/1986 Dodge ..... 271/274
5,129,749 A * 7/1992 Sato ..... 400/639

FOREIGN PATENT DOCUMENTS

JP 08-011375 A 1/1996

* cited by examiner

*Primary Examiner*—David H Bollinger
(74) *Attorney, Agent, or Firm*—Panitch Schwarze Belisario & Nadel LLP

(57) ABSTRACT

A medium conveying apparatus has: a conveying roller shaft arranged so as to be movable vertically; a pressing member which presses the conveying roller shaft in plural positions; and an urging member which urges the pressing member toward a conveying path of a medium. The whole pressing member is pushed up when the medium is inserted and a part of the pressing member is pushed up. Since the pressing member presses the conveying roller shaft in the medium width direction with a uniform pressing force, the uniform pressing force is applied to the medium in the width direction. The occurrence of a variation in the conveying forces and the occurrence of the oblique movement of the medium can be avoided. The medium can be stabilized and conveyed with the sufficient conveying force.

15 Claims, 17 Drawing Sheets

MEDIUM CONVEYING APPARATUS

BACKGROUND OF THE INVENTION

1. Field of the Invention

The invention relates to a medium conveying apparatus.

2. Related Background Art

Hitherto, in an image forming apparatus such as printer, copying apparatus, facsimile apparatus, or the like, a medium conveying apparatus is arranged to convey a sheet as a medium (for example, refer to JP-A-8-11375).

The printer among the image forming apparatuses will now be described.

FIG. 2 is a front view showing a main portion of the medium conveying apparatus of the conventional printer. FIG. 3 is a side elevational view showing the main portion of the medium conveying apparatus of the conventional printer. FIG. 4 is a front view showing a state where the sheet has been inserted in the medium conveying apparatus of the conventional printer. FIG. 5 is a side elevational view showing the state where the sheet has been inserted in the medium conveying apparatus of the conventional printer.

In the diagrams, reference numerals 12 and 13 denote side frames of the printer; 14 an upper shaft; and 15 a lower shaft. The upper shaft 14 and the lower shaft 15 are supported to the side frames 12 and 13 through bushes (not shown). Reference numeral 16 denotes an upper guide and 17 indicates a lower guide. The upper guide 16 and the lower guide 17 are fixed to the side frames 12 and 13 in parallel with a distance δ by fixing means such as welding, screws, or the like.

Rollers 21 and 22 are arranged to the upper shaft 14 and the lower shaft 15 in a plurality of positions in the axial direction so as to be come into contact with each other. Tension springs 24 are attached to a plurality of portions of the upper guide 16 via brackets 23. Each tension spring 24 presses the upper shaft 14 toward the lower shaft 15 via a guide piece 26 by a predetermined urging force.

As shown in FIGS. 4 and 5, when a sheet 31 is inserted between the rollers 21 and 22, a proper pressing force is applied to the sheet 31 by the urging force and the sheet 31 is conveyed by a predetermined conveying force in association with the rotation of the rollers 21 and 22.

However, in the conventional medium conveying apparatus, when the sheet 31 comprises thick paper such as postcard, bankbook, or the like, as shown in FIG. 4, the upper shaft 14 is inclined and a variation is caused in conveying forces in the axial direction of the upper shaft 14 and the lower shaft 15. In this case, while a thickness of plain paper is equal to about 0.08 [mm], for example, a thickness of bankbook is equal to about 2 [mm]. Therefore, if the thick paper is used as a sheet 31, the sheet 31 is obliquely conveyed and cannot be stably conveyed.

To solve such a problem, there is a method of dividing the upper shaft 14 into two parts.

FIG. 6 is a front view showing a main portion of another medium conveying apparatus of the conventional printer.

In the diagram, reference numerals 12 and 13 denote the side frames of the printer; 32 and 33 upper shafts; and 15 the lower shaft. The upper shafts 32 and 33 are supported to the side frames 12 and 13 through bushes (not shown) in a cantilever beam manner. The lower shaft 15 is supported to the side frames 12 and 13 through bushes.

Reference numerals 21 and 22 denote the rollers, 24 the tension springs, and 26 the guide pieces.

In this case, since the upper shafts 32 and 33 are both independently supported, even when the sheet 31 as thick paper is conveyed, the upper shafts 32 and 33 are not inclined. Therefore, since no variation is caused in the conveying forces in the axial direction of the upper shafts 32 and 33 and the lower shaft 15, the oblique conveyance of the sheet 31 can be prevented and the sheet 31 can be stably conveyed.

However, since the upper shafts 32 and 33 are supported in the cantilever beam manner, the sufficient pressing force cannot be applied to the sheet 31 by the urging force of the tension springs 24. The conveying force for the sheet 31 cannot be sufficiently generated in association with the rotation of the rollers 21 and 22.

In the case of a printer constructed in such a manner that the sheet 31 is inserted along a guide arranged in a predetermined position on a table (not shown) of the printer, the upper shafts 32 and 33 can be independently arranged as mentioned above. However, In the case of a printer constructed in such a manner that the sheet 31 can be inserted into an arbitrary position in the width direction on the table, the upper shafts 32 and 33 are inclined in dependence on the position where the sheet 31 is inserted.

SUMMARY OF THE INVENTION

It is an object of the invention to solve the problems in the conventional medium conveying apparatus and provide a medium conveying apparatus which can stabilize a medium and convey it by a sufficient conveying force.

According to the present invention, there is provided a medium conveying apparatus, comprising:

a shaft which is movable along a leaving direction with respect to a conveying path of medium; and a pressing member which presses the shaft in its several positions for making the shaft to approach the conveying path, wherein the pressing member makes the shaft to leave in parallel with the conveying path when the shaft is made to leave the conveying path by the medium.

In the medium conveying apparatus, the pressing member is made from a rigid material which is almost not deformed when its own is pressed by an external force.

Further, in the medium conveying apparatus, the pressing member presses the conveying roller shaft in at least one position in an area where the medium is conveyed.

Furthermore, in the medium conveying apparatus, an adjusting portion which adjusts a pressing state of the conveying roller shaft is arranged in at least one of supporting mechanisms at both ends of the pressing member.

Further, in the medium conveying apparatus, the pressing member constructs a part of a guide which guides the medium.

Furthermore, in the medium conveying apparatus, the pressing member is mounted such as being rotatable.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings. In this case, a printer among image forming apparatuses will be explained.

Figure 7:
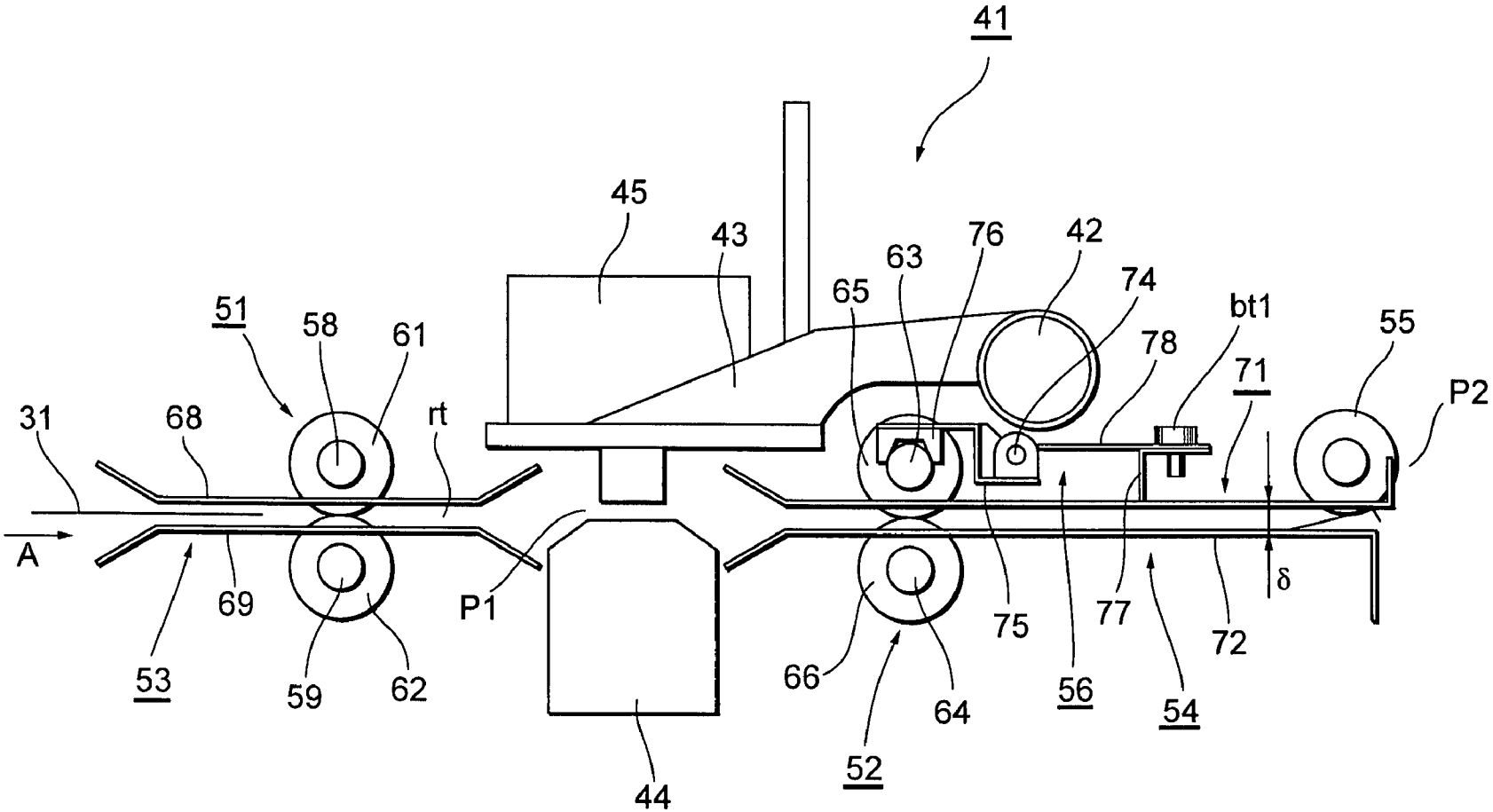
FIG. 7 is a schematic diagram showing a main portion of a printer in the first embodiment of the invention.
Figure 8:
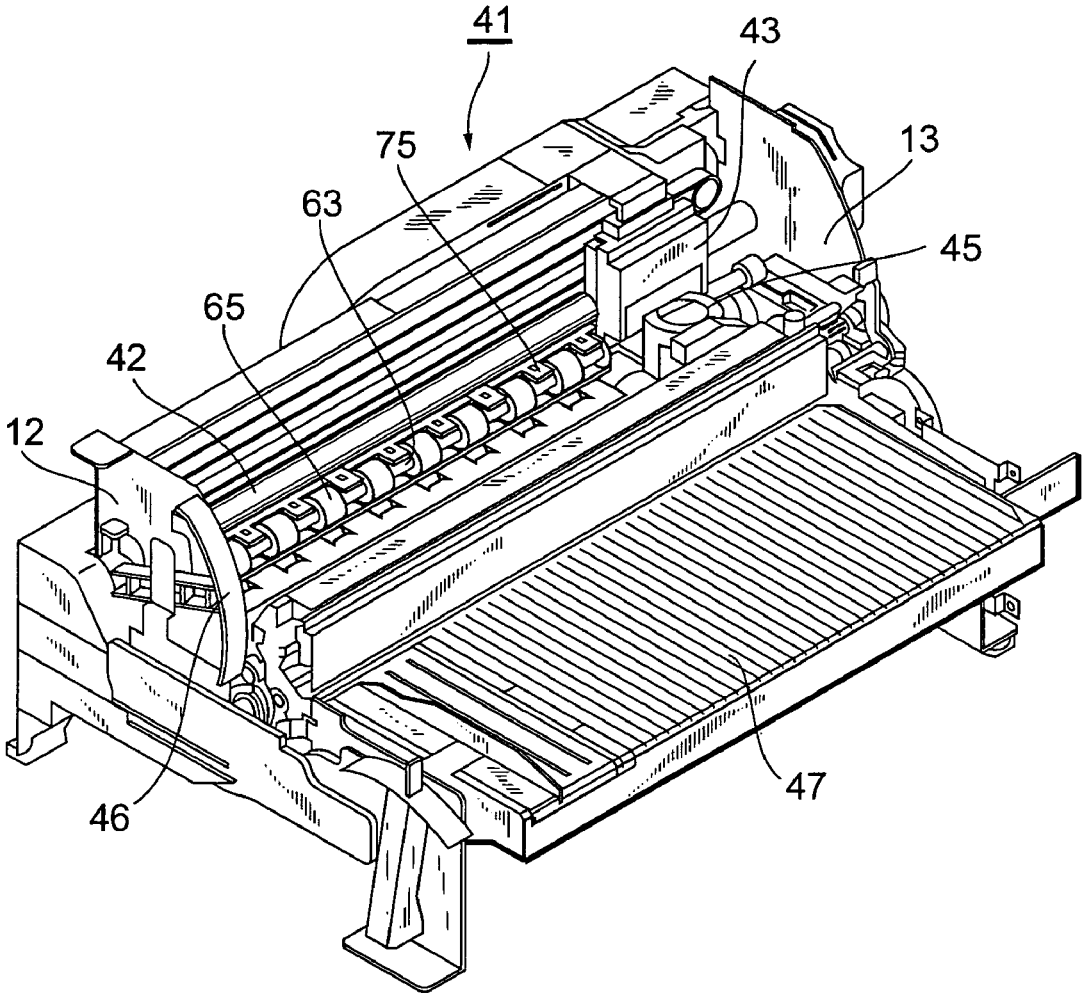
FIG. 8 is a first perspective view showing the main portion of the printer in the first embodiment of the invention.
Figure 9:
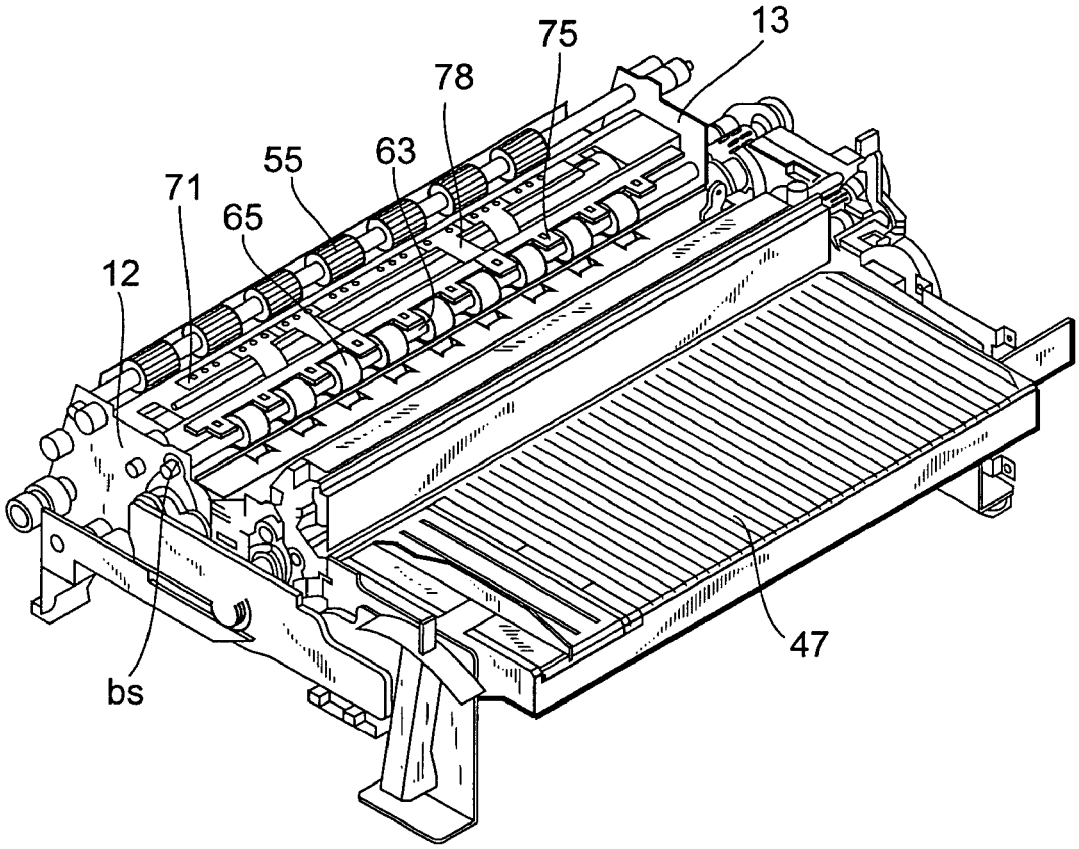
FIG. 9 is a second perspective view showing the main portion of the printer in the first embodiment of the invention.

FIG. 7 is a schematic diagram showing a main portion of the printer in the first embodiment of the invention. FIG. 8 is a first perspective view showing the main portion of the printer in the first embodiment of the invention. FIG. 9 is a second perspective view showing the main portion of the printer in the first embodiment of the invention.

In the diagrams, reference numeral 41 denotes a printer and 12 and 13 indicate the side frames of the printer 41. A carriage shaft 42 is arranged between the side frames 12 and 13. A carriage 43 is arranged so as to be freely moved to the right and left along the carriage shaft 42. Reference numeral 44 denotes a platen arranged in parallel with the carriage shaft 42; 45 a print head as a recording head which is mounted on the carriage 43 so that a front edge faces the platen 44; 46 a head gap adjusting lever for adjusting a head gap indicative of a distance between the print head 45 and the platen 44; and 47 a table for setting the sheet 31 as a medium. A printing portion P1 is formed between the print head 45 and the platen 44.

A medium conveying apparatus is arranged to convey the sheet 31 set on the table 47 in the direction shown by an arrow A. The medium conveying apparatus comprises: a front feed roller 51 arranged on the upstream side of the print head 45 in the conveying direction of the sheet 31; a rear feed roller 52 arranged on the downstream side of the print head 45 in the conveying direction of the sheet 31; a guide 53 which is arranged between the table 47 and the printing portion P1 and guides the sheet 31; a guide 54 which is arranged between the printing portion P1 and an ejecting portion P2 and guides the sheet 31; a stacker roller 55 which is arranged in the ejecting portion P2 and used for ejecting the sheet 31 conveyed by the rear feed roller 52 to a stacker (not shown); a pressing mechanism portion 56 for applying a proper pressing force to the sheet 31 which is conveyed by the rear feed roller 52; and the like.

In order to supply the sheet 31 set on the table 47 to the printing portion P1, the front feed roller 51 comprises: an upper shaft 58 as a first conveying roller shaft arranged on the upper side of a conveying path rt of the sheet 31; and a lower shaft 59 arranged on the lower side of the conveying path rt. Rollers 61 and 62 are arranged to the upper shaft 58 and the lower shaft 59 in a plurality of positions in the axial direction so as to be come into contact with each other. In order to convey the sheet 31 after the recording is executed, in the embodiment, the printing is executed by the print head 45 to the ejecting portion P2, the rear feed roller 52 comprises: an upper shaft 63 as a second conveying roller shaft arranged on the upper side of the conveying path rt; and a lower shaft 64 arranged on the lower side of the conveying path rt. Rollers 65 and 66 are arranged to the upper shaft 63 and the lower shaft 64 in a plurality of positions in the axial direction so as to be come into contact with each other. The upper shafts 58 and 63 and the lower shafts 59 and 64 are rotatably supported to the side frames 12 and 13 by bushes (for example, in the case of the upper shaft 63, a bush bs), respectively. The upper shafts 58 and 63 are movably arranged and, in the embodiment, they are arranged vertically movably against the lower shafts 59 and 64.

The guide 53 has an upper guide 68 arranged on the upper side of the conveying path rt and a lower guide 69 arranged on the lower side of the conveying path rt. The guide 54 has an upper guide 71 arranged on the upper side of the conveying path rt and a lower guide 72 arranged on the lower side of the conveying path rt. The upper guides 68 and 71 and the lower guides 69 and 72 are fixed to the side frames 12 and 13 in parallel with the predetermined distance δ by fixing means such as welding, screws, or the like.

The pressing mechanism portion 56 comprises: a tension plate 75 as a pressing member which is supported to the side frames 12 and 13 through bushes (not shown) on the downstream side of the rear feed roller 52 in the conveying direction of the sheet 31 and is supported so as to swing freely around each fulcrum portion 74 as a center; guide pieces 76 attached to front edges of the tension plate 75; a plurality of tension springs 78 as an urging member attached to a bracket 77 (by a fixing member such as a bolt bt1 or the like) formed by bending a part of the upper guide 71; and the like. When each tension spring 78 urges the tension plate 75 toward the conveying path rt by a predetermined urging force, the tension plate 75 presses the upper shaft 63 in predetermined positions via the guide pieces 76, thereby pressing the roller 65 toward the roller 66 by a predetermined pressing force. In this manner, a proper pressing force is applied to the sheet 31 by the urging force and the sheet 31 is conveyed by a predetermined conveying force in association with the rotation of the rollers 65 and 66. The tension plate 75 presses the upper shaft 63 in a predetermined positions.

The tension plate 75 will now be described in detail.

Figure 10:
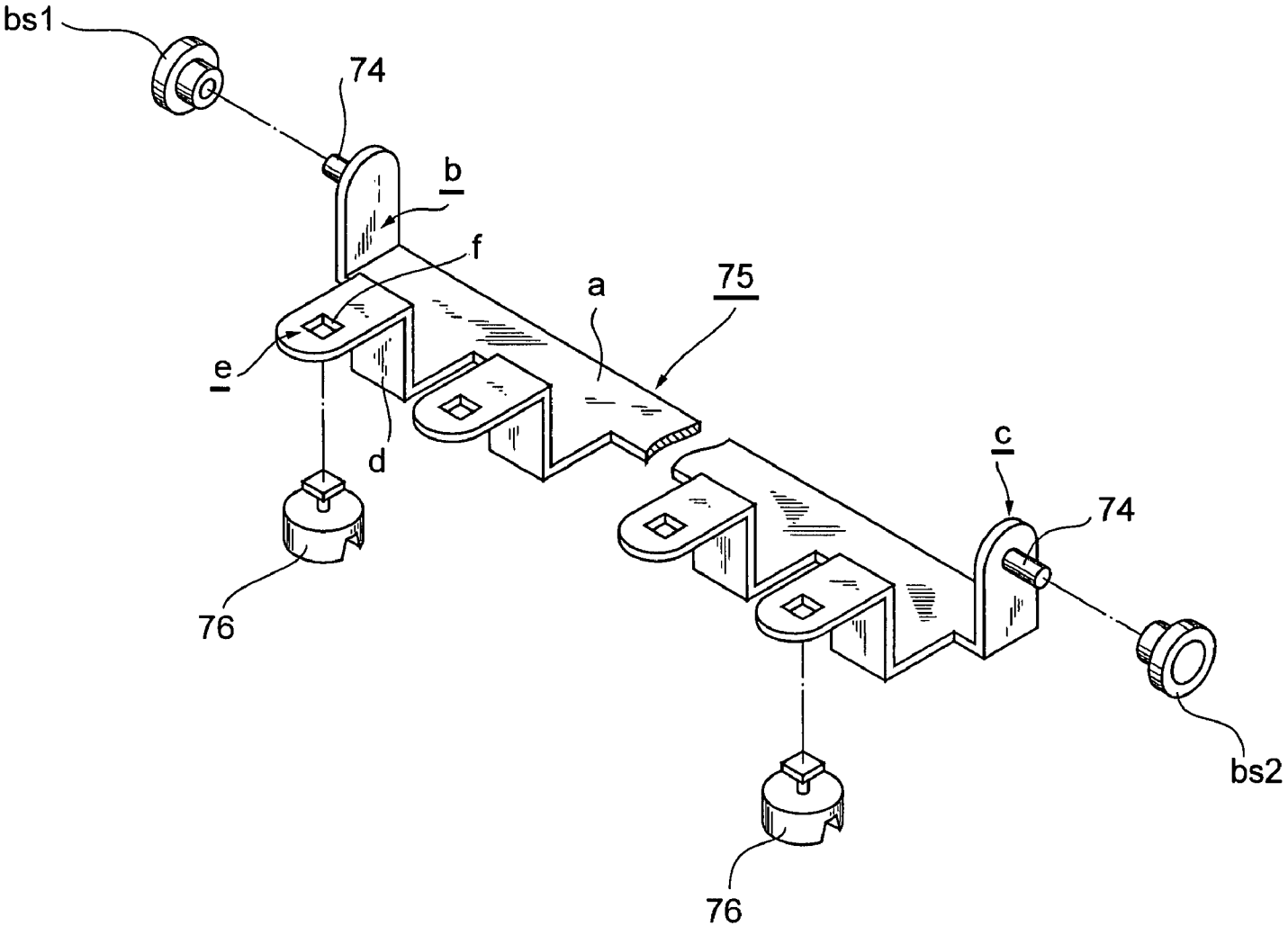
FIG. 10 is a perspective view of a tension plate in the first embodiment of the invention.

FIG. 10 is a perspective view of the tension plate in the first embodiment of the invention.

As shown in the diagram, the tension plate 75 comprises: a base portion (a) extending in parallel with the upper shaft 63 at almost the same position as a center of the upper shaft 63 (FIG. 7) in the height direction; rising portions (b and c) formed by vertically bending upward both ends of the base portion (a); the fulcrum portions 74 which are formed so as to be projected outwardly from the rising portions (b and c) and retained to bushes bs1 and bs2, respectively; supporting portions (d) formed by vertically bending upward a plate of the base portion (a) in a plurality of positions in the longitudinal direction of the base portion (a); and pressing portions (e) formed horizontally from upper edges of the supporting portions (d) toward the upstream side in the conveying direction of the sheet 31. A hole (f) to attach the guide piece 76 is formed in each pressing portion (e). A supporting mechanism of the tension plate 75 is constructed by the side frames 12 and 13, the bushes bs1 and bs2, and the like.

Since the urging force is applied to the tension plate 75 by the tension springs 78 in the predetermined pressing portions (e), the tension plate 75 is made of a material which is not deformed even when it receives the urging force, for example, a rigid material such as steel, die-cast, or the like.

The operation of the medium conveying apparatus with the foregoing construction will now be described.

Figure 1:
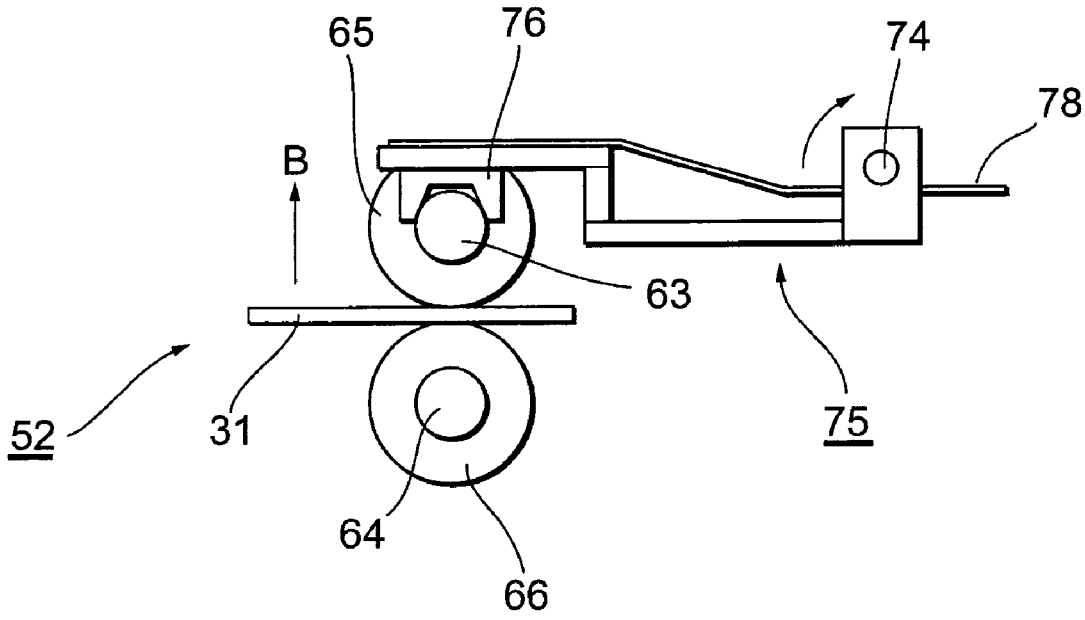
FIG. 1 is a side elevational view showing a state where a sheet has been inserted between rollers of a rear feed roller in the first embodiment of the invention.
Figure 2:
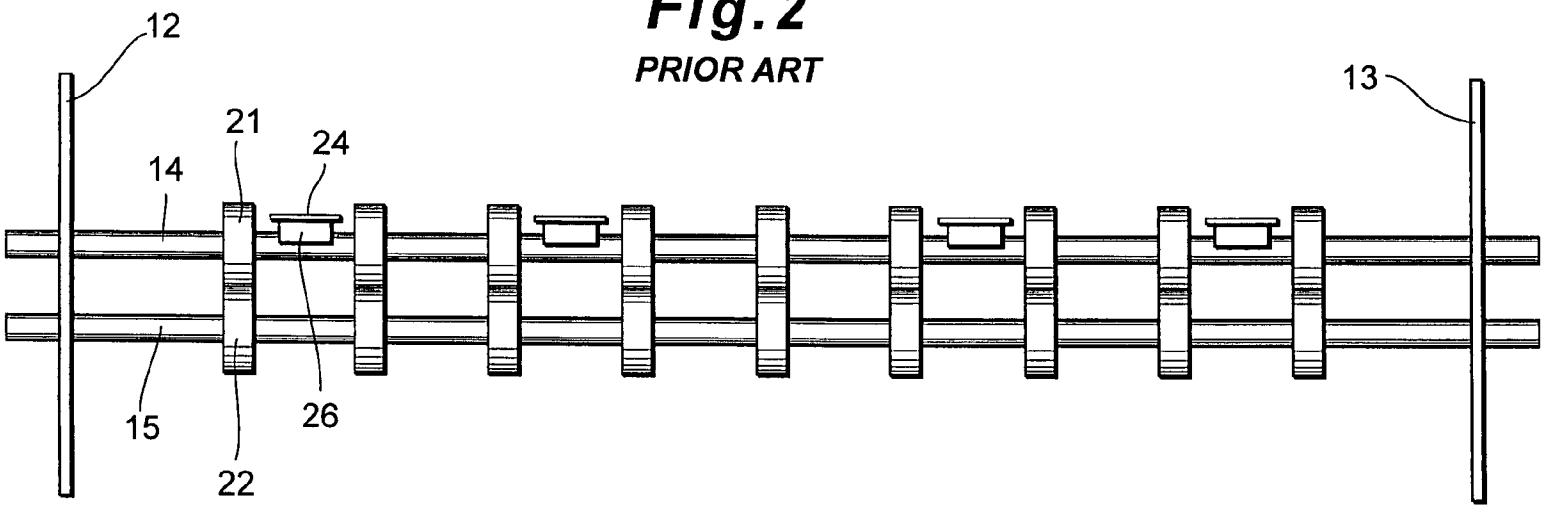
Fig. 2 PRIOR ART
FIG. 2 is a front view showing a main portion of a medium conveying apparatus of a conventional printer.
Figure 3:
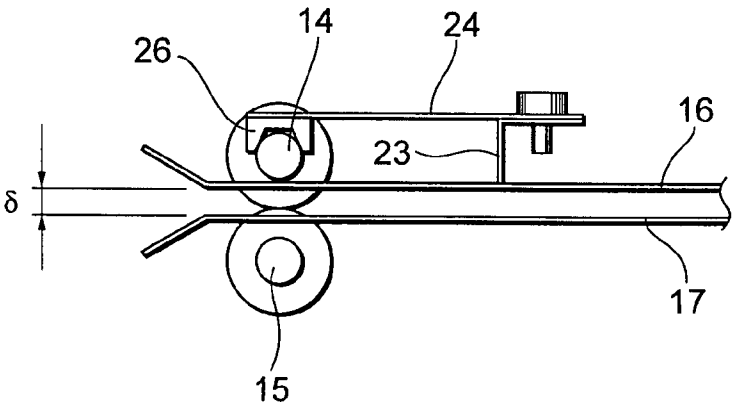
Fig. 3 PRIOR ART
FIG. 3 is a side elevational view showing the main portion of the medium conveying apparatus of the conventional printer.
Figure 4:
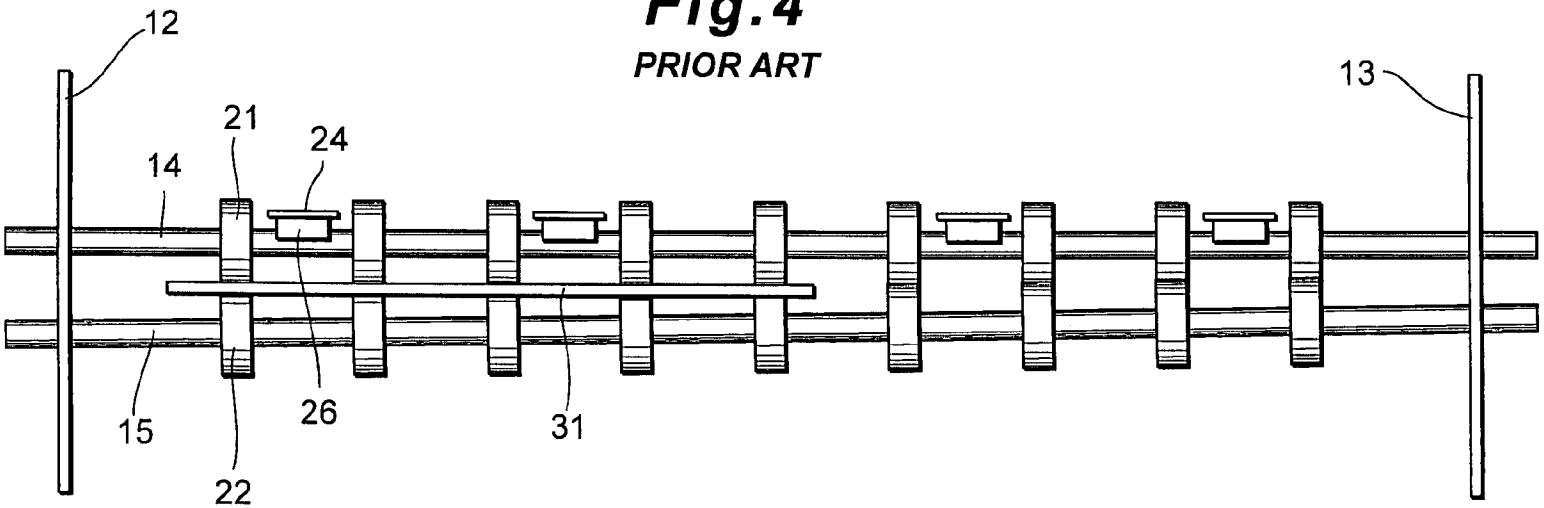
Fig. 4 PRIOR ART
FIG. 4 is a front view showing a state where a sheet has been inserted in the medium conveying apparatus of the conventional printer.
Figure 5:
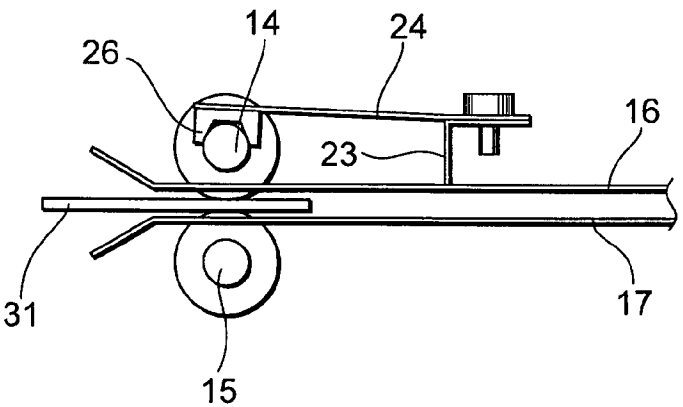
Fig. 5 PRIOR ART
FIG. 5 is a side elevational view showing the state where the sheet has been inserted in the medium conveying apparatus of the conventional printer.
Figure 6:
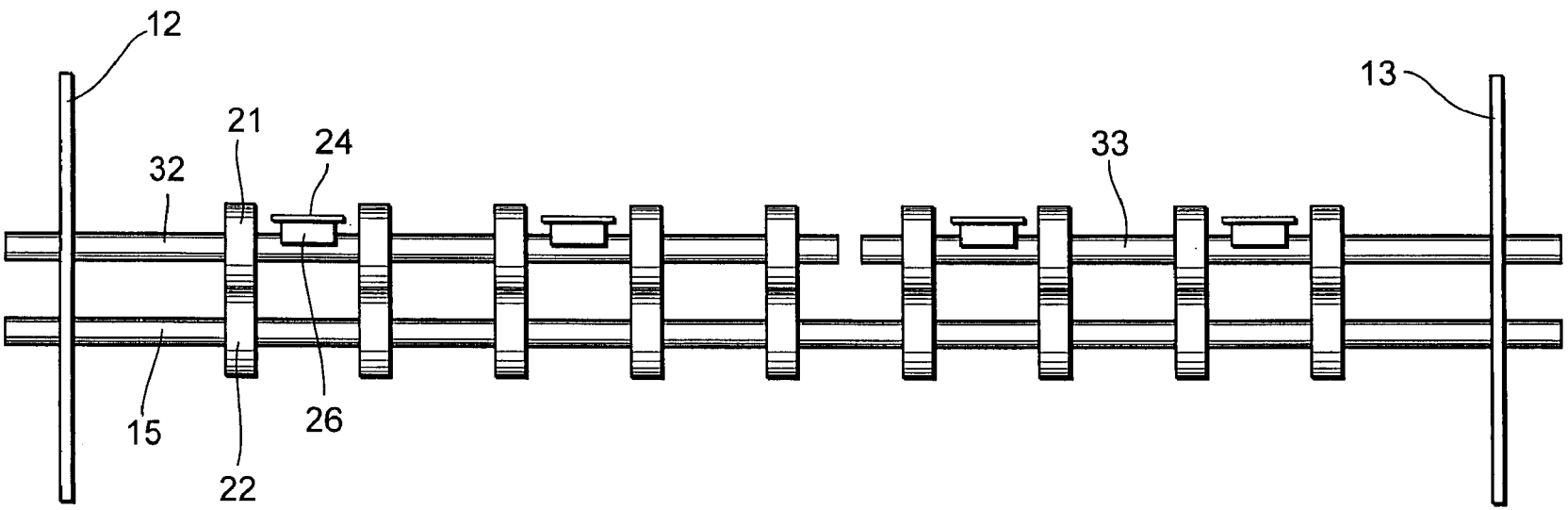
Fig. 6 PRIOR ART
FIG. 6 is a front view showing a main portion of another medium conveying apparatus of the conventional printer.
Figure 11:
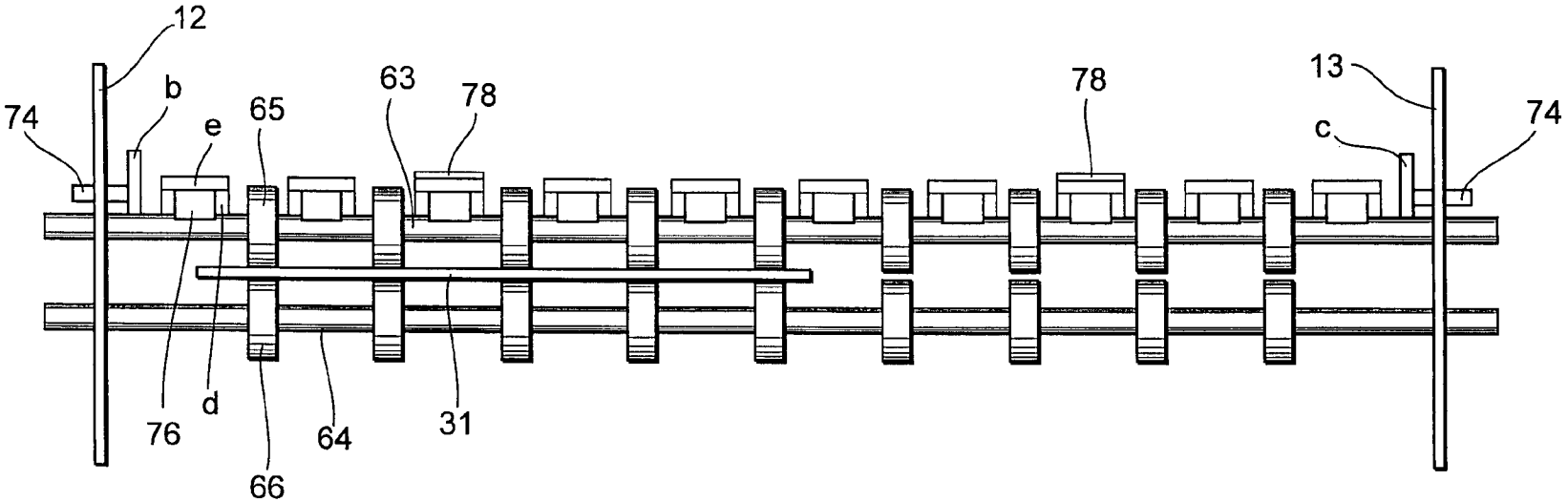
FIG. 11 is a front view showing a state where a sheet has been inserted to the left side of a gap between rollers of the rear feed roller in the first embodiment of the invention.
Figure 12:
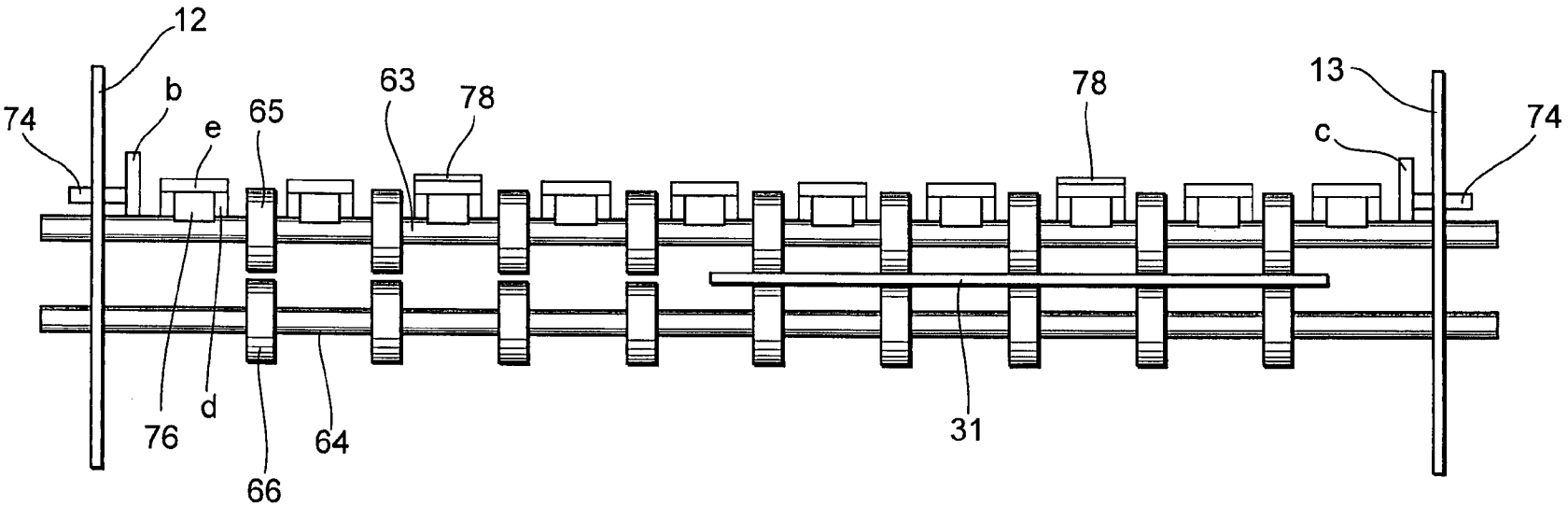
FIG. 12 is a front view showing a state where a sheet has been inserted to the right side of a gap between the rollers of the rear feed roller in the first embodiment of the invention.
Figure 13:
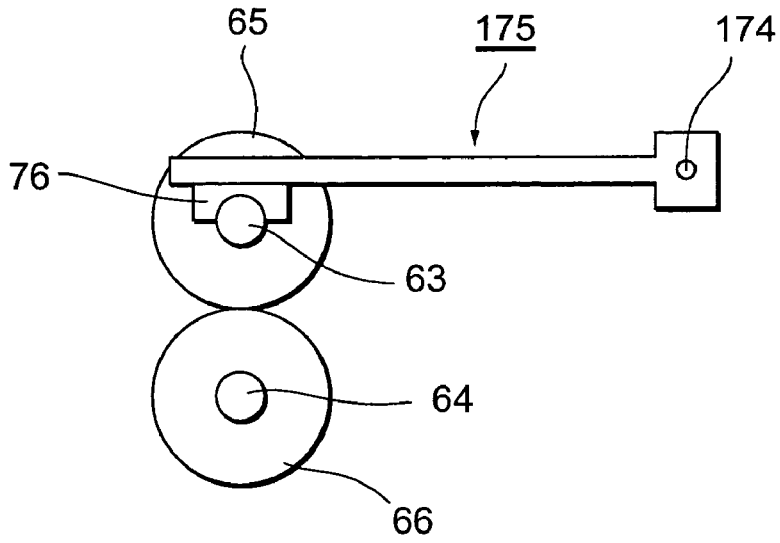
FIG. 13 is a side elevational view showing another example of the tension plate in the first embodiment of the invention.
Figure 14:
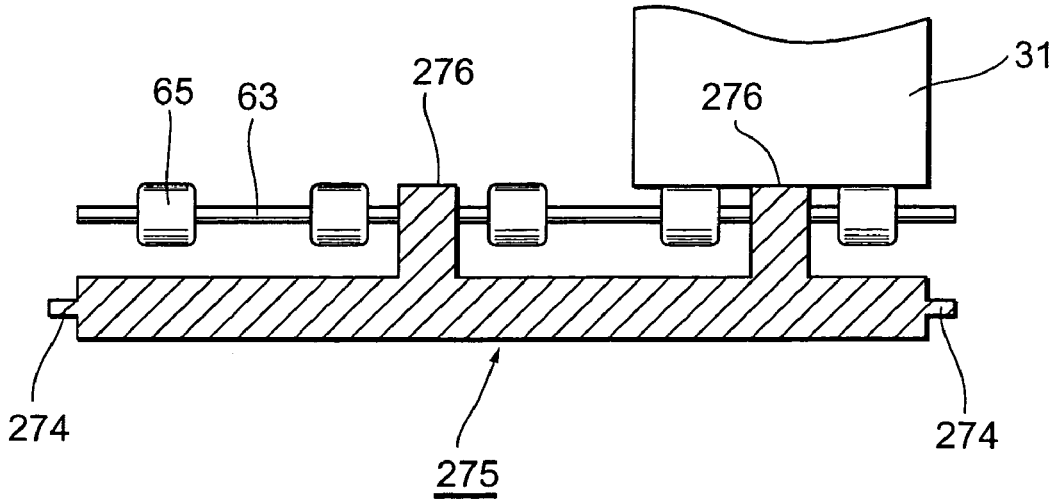
FIG. 14 is a plan view showing another example of the tension plate in the first embodiment of the invention.

FIG. 1 is a side elevational view showing a state where the sheet has been inserted between the rollers of the rear feed roller in the first embodiment of the invention. FIG. 11 is a front view showing a state where the sheet has been inserted to the left side of a gap is between the rollers of the rear feed roller in the first embodiment of the invention. FIG. 12 is a front view showing a state where the sheet has been inserted to the right side of a gap between the rollers of the rear feed roller in the first embodiment of the invention. FIG. 13 is a side elevational view showing another example of the tension plate in the first embodiment of the invention. FIG. 14 is a plan view showing another example of the tension plate in the first embodiment of the invention.

When the sheet 31 is inserted between the rollers 65 and 66, first, the upper shaft 63 is pushed up in the direction shown by an arrow B by an amount corresponding to the thickness of the sheet 31. At this time, the pressing portion (e) of the tension plate 75 is pushed up via the guide piece 76 which is directly in contact with the upper shaft 63. In association with it, the tension plate 75 is rotated around the fulcrum portion 74 as a fulcrum by an angle corresponding to the thickness of the sheet 31. In this case, when the roller 65 is pushed up in one end portion of the upper shaft 63 in association with the insertion of the sheet 31, one end portion of the tension plate 75 is also pushed up. At this time, since the tension plate 75 is made of the rigid material and does not easily change the shape even if a stress is applied, the whole tension plate is pushed up in association with the pushing-up of a part of the tension plate, for example, one end portion thereof. Thus, the other end portion is also pushed up by the same amount as that in the case of one end portion.

Therefore, the whole tension plate 75 is integratedly rotated in association with the insertion of the sheet 31 without being twisted. That is, even when the sheet 31 is inserted to the end portion of the left side of the gap between the rollers 65 and 66 as shown in FIG. 11 or is inserted to the end portion of the right side of the gap between the rollers 65 and 66 as shown in FIG. 12, or even when the sheet 31 is thin paper or thick paper, the tension plate 75 is uniformly rotated in the width direction of the sheet 31 by the angle corresponding to the thickness of the sheet 31.

As shown by FIG. 11, when the sheet is conveyed, the left side of the upper shaft is pushed up. Thus, the tension plate is also wholly pushed up. In the case, because the tension plate is wholly pushed up, so the right side of the upper shaft loses the pressure of the tension plate and becomes free.

That is, by using the tension plate, when the left side of the upper shaft is pushed up, the right side of the upper shaft is also pushed up. Thereby, the upper shaft is always kept in parallel, and it does not become slanting with respect to the conveying path of the sheet.

Therefore, since the tension plate 75 presses the roller 65 in the width direction of the sheet 31 with the uniform pressing force, the uniform pressing force is applied to the sheet 31 in the width direction. The occurrence of a variation in the conveying forces can be prevented and the occurrence of the oblique movement of the sheet 31 can be avoided.

Since the roller 65 is pressed to the roller 66 via the tension plate 75 extending in the width direction of the sheet 31 and made of the rigid material as mentioned above, the sheet 31 can be stabilized and conveyed with the sufficient conveying force without being influenced by the thickness, dimensions, setting position, and the like of the sheet 31.

A tension plate 175 as shown in FIG. 13 can be used as a pressing member in place of the tension plate 75. The tension plate 175 has a flat structure, is arranged to the side frames 12 and 13 via a fulcrum portion 174 so that it can swing freely, and presses the upper shaft 63 via the guide piece 76.

A tension plate 275 as shown in FIG. 14 can be used as a pressing member in place of the tension plate 75. In the diagram, reference numeral 274 denotes fulcrum portions formed at both ends of the tension plate 275. The tension plate 275 has pressing portions 276 in parts of the upper shaft 63 in the axial direction. In this case, one pressing portion 276 is formed in at least one position in an area where the sheet 31 is conveyed. The upper shaft 63 is pressed by the pressing portion 276.

In the diagrams, reference numerals 12 and 13 denote the side frames; 64 the lower shaft; 78 the tension springs; (b and c) the rising portions; and (d) the supporting portions.

Since the tension plates 75, 175, and 275 are made of steel plates or the like, there is a case where deformation such as twist, warp, or the like occurs when they are worked.

Figure 15:
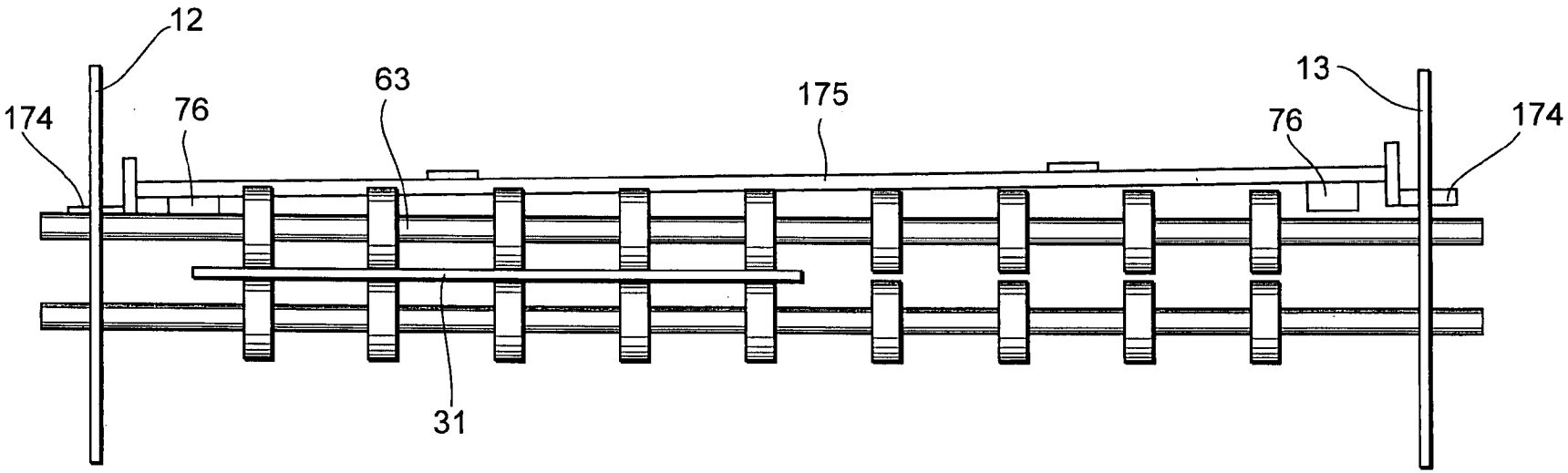
FIG. 15 is a diagram showing a state where deformation occurred in the tension plate in the first embodiment of the invention.

FIG. 15 is a diagram showing a state where deformation occurred in the tension plate in the first embodiment of the invention. In this case, an example using the flat tension plate 175 will be explained.

As shown in the diagram, when deformation occurs in the tension plate 175, a gap is formed between the predetermined guide piece 76 and the upper shaft 63, unsteadiness occurs on both of the right and left sides, the pressing forces which are applied to the sheet 31 are not uniform in the width direction, and a variation is caused in the conveying forces.

In the diagram, reference numerals 12 and 13 denote the side frames and 174 indicates the fulcrum portions.

The second embodiment of the invention in which even if deformation occurs in the tension plate 75, 175, 275, or the like, the occurrence of a variation in the conveying forces can be prevented will now be described. Component elements having the same structures as those in the first embodiment are designated by the same reference numerals and their description is omitted here. Effects similar to those in the first embodiment of the invention are also obtained by the component elements having the same structures as those in the first embodiment.

Figure 16:
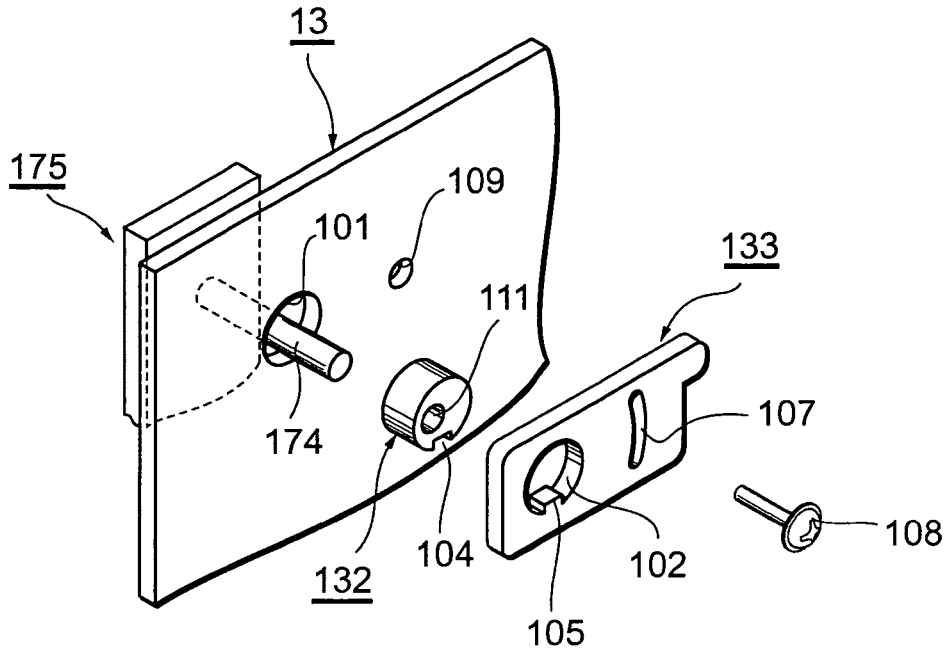
FIG. 16 is a perspective view showing a supporting mechanism of a tension plate in the second embodiment of the invention.
Figure 17:
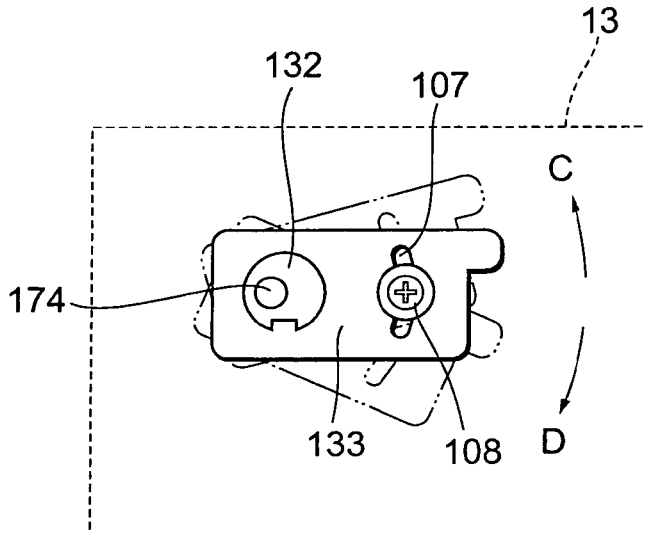
FIG. 17 is a first diagram showing the operation of the supporting mechanism of the tension plate in the second embodiment of the invention.
Figure 18:
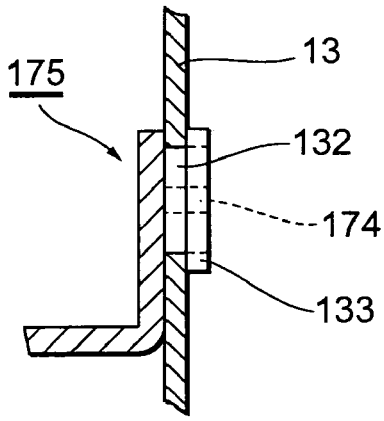
FIG. 18 is a second diagram showing the operation of the supporting mechanism of the tension plate in the second embodiment of the invention.
Figure 19:
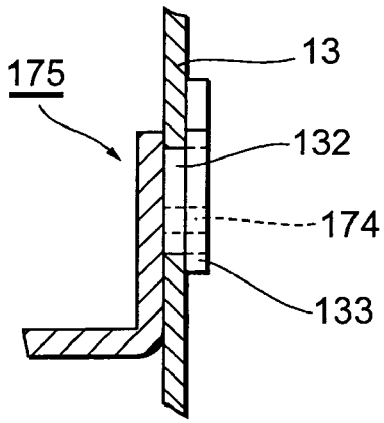
FIG. 19 is a third diagram showing the operation of the supporting mechanism of the tension plate in the second embodiment of the invention.
Figure 20:
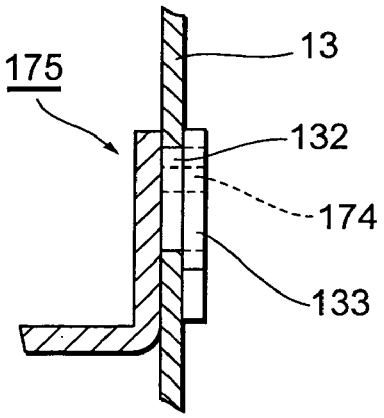
FIG. 20 is a fourth diagram showing the operation of the supporting mechanism of the tension plate in the second embodiment of the invention.

FIG. 16 is a perspective view showing a supporting mechanism of the tension plate in the second embodiment of the invention. FIG. 17 is a first diagram showing the operation of the supporting mechanism of the tension plate in the second embodiment of the invention. FIG. 18 is a second diagram showing the operation of the supporting mechanism of the tension plate in the second embodiment of the invention. FIG. 19 is a third diagram showing the operation of the supporting mechanism of the tension plate in the second embodiment of the invention. FIG. 20 is a fourth diagram showing the operation of the supporting mechanism of the tension plate in the second embodiment of the invention.

In this case, an adjusting portion to adjust the pressing state of the upper shaft 63 as a second conveying roller shaft is arranged for at least one of the supporting mechanisms at both ends of the tension plate 175 as a pressing member. For this purpose, an eccentric collar 132 to adjust unsteadiness is arranged in at least one of the fulcrum portions 174. One end of the eccentric collar 132 is rotatably inserted into, for example, a slide hole 101 formed in the side frame 13 and the other end is inserted into a retaining hole 102 of an adjusting plate 133. A concave portion 104 extending in the axial direction is formed in a predetermined portion of an outer peripheral surface of the eccentric collar 132. A convex portion 105 extending in the axial direction is formed in a predetermined portion of an inner peripheral surface of the retaining hole 102. The concave portion 104 and the convex portion 105 are come into engagement with each other. A through hole 111 for inserting the fulcrum portion 174 is eccentrically formed in the eccentric collar 132. The adjusting portion is constructed by the eccentric collar 132, the adjusting plate 133, and the like.

Therefore, when the adjusting plate 133 is rotated in the direction shown by an arrow C or D, the eccentric collar 132 is rotated synchronously with the rotation of the adjusting plate 133.

An arc-shaped long groove 107 is formed in the adjusting plate 133. A screw 108 pierces the long groove 107 and is spirally fitted into a screw hole 109 of the side frame 13.

The operation of the supporting mechanism will now be described.

First, as shown in FIG. 17, in the state where the adjusting plate 133 is horizontally placed, the fulcrum portion 174 is set to a reference position shown in FIG. 18. By loosening the screw 108 and rotating the adjusting plate 133 in the direction of the arrow C, the eccentric collar 132 is rotated in the direction of the arrow C together with the adjusting plate 133, so that the fulcrum portion 174 is placed to a lower position shown in FIG. 19 from the reference position. By rotating the adjusting plate 133 in the direction of the arrow D, the eccentric collar 132 is rotated in the direction of the arrow D together with the adjusting plate 133, so that the fulcrum portion 174 is placed to an upper position shown in FIG. 20 from the reference position.

For example, on the side frame 13 side, since the fulcrum portion 174 can be moved vertically and the pressing state of the upper shaft 63 can be adjusted as mentioned above, even if deformation occurs in the tension plate 175, no gap is formed between each guide piece 76 and the upper shaft 63 and the occurrence of unsteadiness on the right and left sides can be prevented. Therefore, the pressing forces which are applied to the sheet 31 as a medium can be uniformed in the width direction of the sheet 31 and the occurrence of the variation in the conveying forces can be avoided.

The third embodiment of the invention will now be described. Component elements having the same structures as those in the first embodiment are designated by the same reference numerals and their description is omitted here. Effects similar to those in the first embodiment of the invention are also obtained by the component elements having the same structures as those in the first embodiment.

Figure 21:
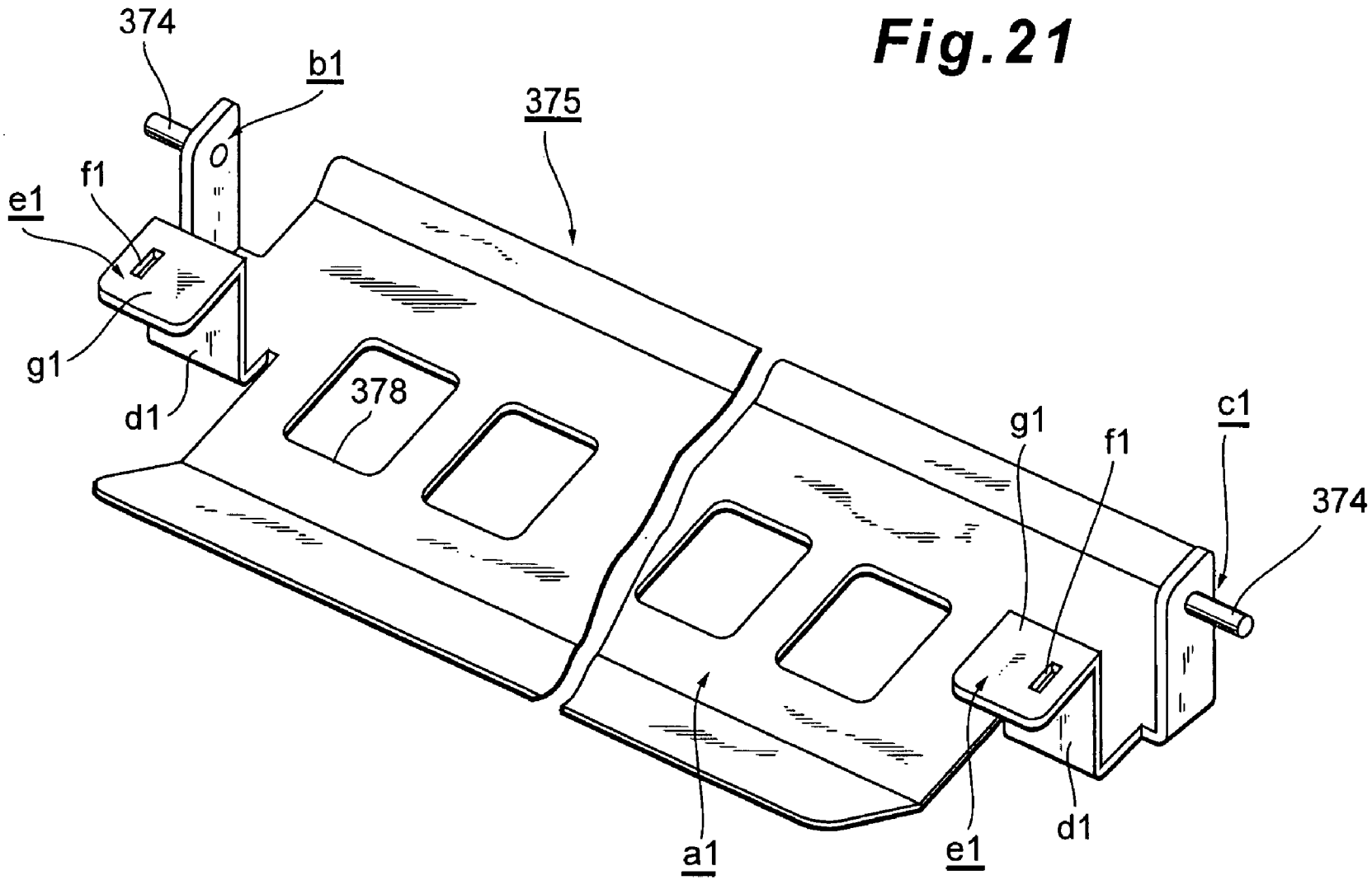
FIG. 21 is a perspective view of a tension plate in the third embodiment of the invention.
Figure 22:
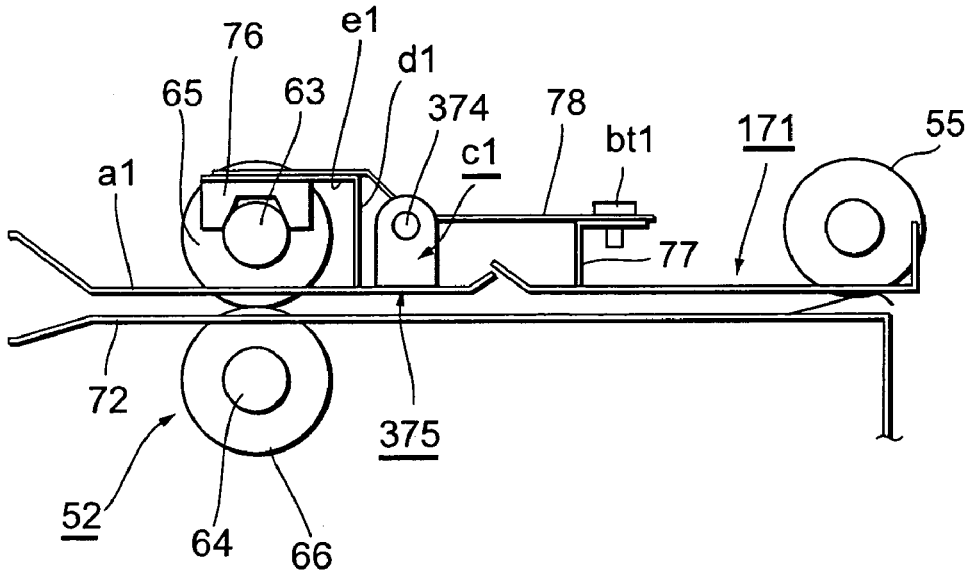
FIG. 22 is a first side elevational view showing the operation of a medium conveying apparatus in the third embodiment of the invention.
Figure 23:
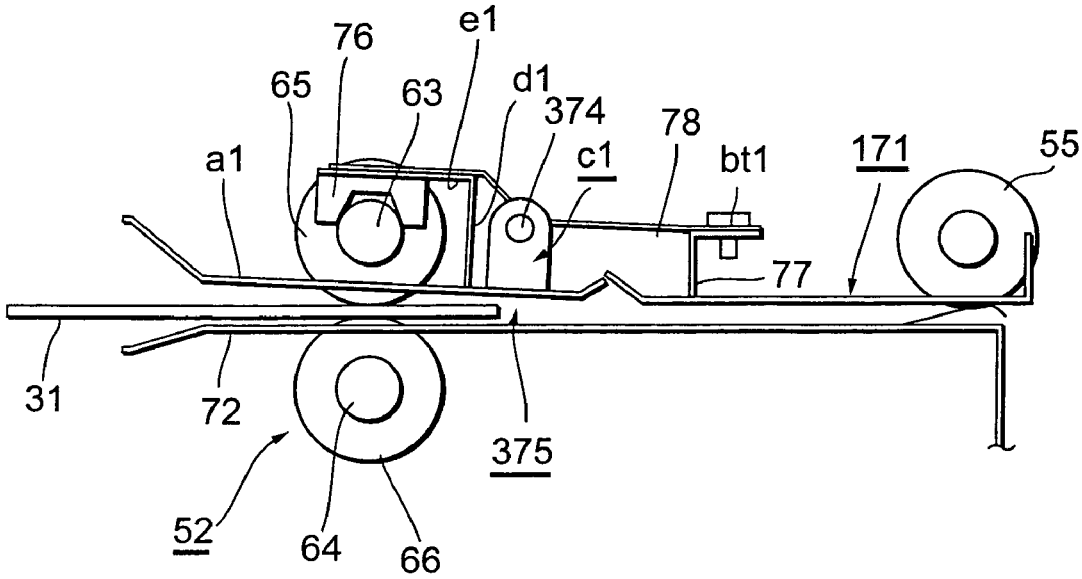
FIG. 23 is a second side elevational view showing the operation of the medium conveying apparatus in the third embodiment of the invention.

FIG. 21 is a perspective view of the tension plate in the third embodiment of the invention. FIG. 22 is a first side elevational view showing the operation of a medium conveying apparatus in the third embodiment of the invention. FIG. 23 is a second side elevational view showing the operation of the medium conveying apparatus in the third embodiment of the invention.

In the diagrams, reference numeral 375 denotes a tension plate as a pressing member. The tension plate 375 comprises: a base portion a1 which is extended in parallel with the upper shaft 63 as a second conveying roller shaft and also functions as an upper guide constructing a part of a guide for guiding the sheet 31 as a medium; rising portions b1 and c1 formed by vertically bending upward both ends of the base portion a1; fulcrum portions 374 which are formed so as to be projected outwardly from the rising portions b1 and c1 and retained to bushes (not shown), respectively; supporting portions d1 formed by vertically bending upward a plate of the base portion a1 in a plurality of positions in the longitudinal direction of the base portion al; and pressing portions e1 formed horizontally from upper edges of the supporting portions d1 toward the upstream side in the conveying direction of the sheet 31. A hole f1 to attach the guide piece 76 and a spring receiving portion g1 which receives the tension spring 78 as an urging member are formed in each pressing portion e1.

Reference numeral 171 denotes an upper guide. The bracket 77 is formed on the upper guide 171. A few escape holes 378 for positioning the rollers 65 are formed in the base portion a1.

The operation of the medium conveying apparatus will now be described.

When the sheet 31 is inserted between the rollers 65 and 66, first, the upper shaft 63 is pushed up by an amount corresponding to the thickness of the sheet 31. At this time, the pressing portion e1 of the tension plate 375 is pushed up via the guide piece 76 which is directly in contact with the upper shaft 63. In association with it, the tension plate 375 is rotated around the fulcrum portion 374 as a fulcrum by an angle corresponding to the thickness of the sheet 31. In this case, when the roller 65 is pushed up in one end portion of the upper shaft 63 in association with the insertion of the sheet 31, one end portion of the tension plate 375 is also pushed up. At this time, since the tension plate 375 is made of the rigid material and does not easily change the shape even if a stress is applied, when one end portion is pushed up, the other end portion is also pushed up by the same amount as that in the case of one end portion.

Therefore, since the tension plate 375 presses the roller 65 in the width direction of the sheet 31 with the uniform pressing force, the uniform pressing force is applied to the sheet 31 in the width direction. The occurrence of a variation in the conveying forces can be prevented and the occurrence of the oblique movement of the sheet 31 can be avoided.

Since the roller 65 is pressed to the roller 66 via the tension plate 375 extending in the width direction of the sheet 31 and made of the rigid material as mentioned above, the sheet 31 can be stabilized and conveyed with the sufficient conveying force without being influenced by the thickness, dimensions, setting position, and the like of the sheet 31.

In association with the rotation of the tension plate 375, the base portion a1 is also rotated and a gap between the base portion a1 and the lower guide 72 is widened. Therefore, even if the sheet 31 is thick paper, it can be smoothly conveyed without being hooked.

The fourth embodiment of the invention in which the tension plate is supported on the upstream side of the rear feed roller 52 in the conveying direction of the sheet 31 will now be described. Component elements having the same structures as those in the third embodiment are designated by the same reference numerals and their description is omitted here. Effects similar to those in the third embodiment of the invention are also obtained by the component elements having the same structures as those in the third embodiment.

Figure 24:
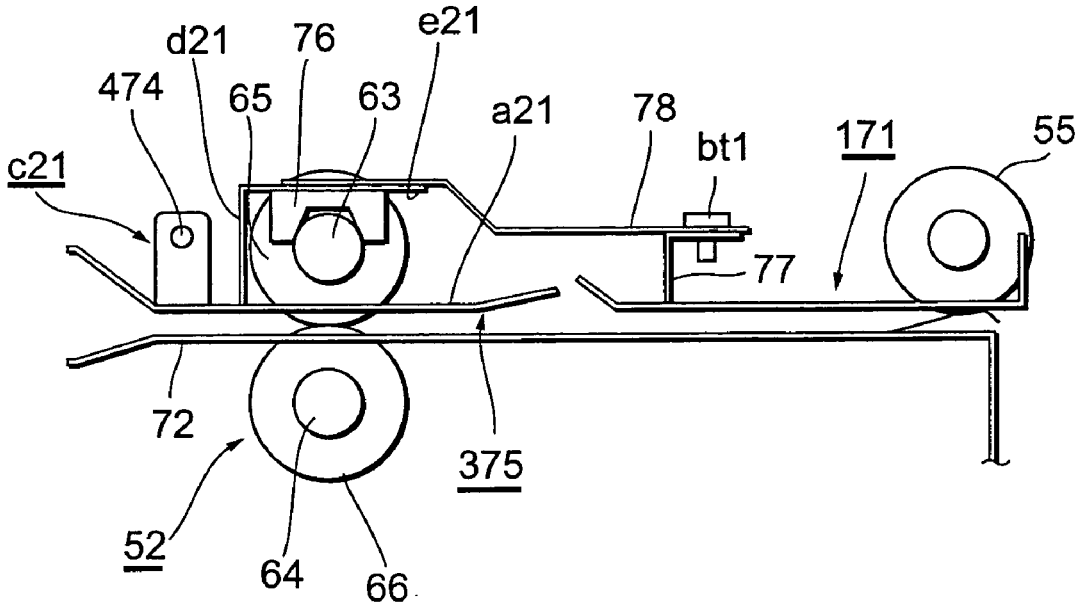
FIG. 24 is a side elevational view showing the operation of a medium conveying apparatus in the fourth embodiment of the invention.

FIG. 24 is a side elevational view showing the operation of a medium conveying apparatus in the fourth embodiment of the invention.

In the diagram, reference numeral 475 denotes a tension plate as a pressing member. The tension plate 475 comprises: a base portion a21 which is extended in parallel with the upper shaft 63 as a second conveying roller shaft and also functions as an upper guide constructing a part of a guide for guiding the sheet 31 as a medium; rising portions c21 (only one of the rising portions c21 is shown in the diagram) formed by vertically bending upward both ends of the base portion a21; fulcrum portions 474 which are formed so as to be projected outwardly from the rising portions c21 and retained to bushes (not shown), respectively; supporting portions d21 formed by vertically bending upward a plate of the base portion a12 at both ends in the longitudinal direction of the base portion a1; and pressing portions e21 formed horizontally from upper edges of the supporting portions d21 toward the downstream side in the conveying direction of the sheet 31. A hole (not shown) to attach the guide piece 76 and a spring receiving portion which receives the tension spring 78 as an urging member are formed in each pressing portion e21.

Although each of the above embodiments has been described with respect to the rear feed roller 52, the invention can be applied to the front feed roller 51.

The invention is not limited to the foregoing embodiments but many modifications and variations are possible within the spirit and scope of the appended claims of the invention.

As described above in detail, according to the invention, the medium conveying apparatus comprises: the conveying roller shaft arranged so as to be movable vertically; the pressing member which presses the conveying roller shaft in a plurality of positions; and the urging member which urges the pressing member toward the conveying path of the medium.

The whole pressing member is pushed up when a part of it is pushed up.

In this case, the whole pressing member is pushed up when the medium is inserted and a part of the pressing member is pushed up. Therefore, since the pressing member presses the conveying roller shaft in the width direction of the medium with the uniform pressing force, the uniform pressing force is applied to the medium in the width direction, the occurrence of a variation in the conveying forces can be prevented and the occurrence of the oblique movement of the medium can be avoided.

The medium can be stabilized and conveyed with the sufficient conveying force without being influenced by the thickness, dimensions, setting position, and the like of the medium.

What is claimed is:

1. A medium conveying apparatus comprising:

a conveying roller shaft movable along a direction corresponding to the thickness of a medium when the medium is conveyed; and a pressing member extending along a length of said shaft, the pressing member being made of a rigid material and pressing the conveying roller shaft, said pressing member including:

a plurality of guide pieces coupled with the conveying roller shaft.

2. The medium conveying apparatus according to claim 1, further comprising:

at least one force providing member which provides a pressure force to said pressing member to press said pressure member against said conveying roller shaft.

3. The medium conveying apparatus according to claim 2, wherein said at least one force providing member is a spring.

4. The medium conveying apparatus according to claim 1, wherein said plurality of guide pieces are installed on said pressing member.

5. The medium conveying apparatus according to claim 1, wherein said pressing member has a base portion, a pressing portion and a supporting portion; said pressing portion and said supporting portion form an "L" shape; said pressing portion and said supporting portion support at least one of said plurality of a guide pieces.

6. The medium conveying apparatus according to claim 1, wherein said rigid material is not deformed when pressed by an external force.

7. The medium conveying apparatus according to claim 1, wherein an adjusting portion adjusts a pressing state of said conveying roller shaft and is arranged in at least one of a supporting mechanism located at both ends of said pressing member.

8. The medium conveying apparatus according to claim 1, wherein said pressing member is rotatably mounted on a pair of side frames of a printer.

9. The medium conveying apparatus according to claim 1, wherein said shaft is pressed uniformly along its length by said pressing member and moves in equilibrium.

10. The medium conveying apparatus according to claim 1, wherein said pressing member is supported so as to swing freely around a fulcrum portion as a center.

11. A medium conveying apparatus comprising:

a conveying roller movable along a thickness direction of a medium when said medium is conveyed; and a pressing member extending in an axis direction of said conveying roller and providing a force to a shaft of said conveying roller toward a conveying path of said medium;

wherein a first side of said shaft of said conveying roller is pushed up when said medium is conveyed through said medium conveying apparatus, thereby a first side of said pressing member is pushed together with said first side of said shaft; an opposite side of said pressing member is also pushed up to approximately a same height as that of said first side of said pressing member so that said force provided by said pressing member does not press a second, opposite side of said shaft.

12. The medium conveying apparatus according to claim 11, wherein said pressing member is rotatably mounted on a pair of side frames of a printer.

13. The medium conveying apparatus according to claim 11, wherein said pressing member is constructed of a rigid material.

14. The medium conveying apparatus according to claim 13, wherein said rigid material does not deform as a result of an external force.

15. A medium conveying apparatus comprising:

a conveying roller shaft movable along a direction corresponding to the thickness of a medium when the medium is conveyed; and a pressing member extending along a length of said shaft, the pressing member being made of a rigid material and pressing the conveying roller shaft, wherein said pressing member includes at least one pressing portion that provides a force to said conveying roller shaft and wherein an adjusting portion adjusts a pressing state of said conveying roller shaft and is arranged in at least one of a supporting mechanism located at both ends of said pressing member.

* * * * *